US006446619B1

(12) United States Patent
McPherson

(10) Patent No.: US 6,446,619 B1
(45) Date of Patent: Sep. 10, 2002

(54) COMPOUND BOW SUITED FOR YOUTH, INTERMEDIATES AND TRAINING

(76) Inventor: Mathew A. McPherson, 19055 Incline Rd., Norwalk, WI (US) 54648

( * ) Notice: Subject to any disclaimer, the term of this patent is extended or adjusted under 35 U.S.C. 154(b) by 0 days.

(21) Appl. No.: 09/603,475

(22) Filed: Jun. 23, 2000

(51) Int. Cl.[7] ..... F41B 5/10
(52) U.S. Cl. ..... 124/25.6
(58) Field of Search ..... 124/25.6, 900

(56) References Cited

U.S. PATENT DOCUMENTS 4,838,236 A * 6/1989 Kudlacek
5,368,006 A * 11/1994 McPherson ..... 124/25.6
5,649,522 A 7/1997 Troncoso ..... 124/25.6
5,934,265 A * 8/1999 Darlington ..... 124/25.6
5,960,778 A 10/1999 Larson ..... 124/35.6
5,975,067 A 11/1999 Strother ..... 124/25.6
6,082,346 A * 7/2000 Andrews et al. ..... 124/25.6
6,082,347 A * 7/2000 Darlington ..... 124/25.6
6,112,732 A * 9/2000 Larson ..... 124/25.6

* cited by examiner

*Primary Examiner*—John A. Ricci
(74) *Attorney, Agent, or Firm*—Vidas, Arrett & Steinkraus

(57) ABSTRACT

An archery bow having a substantially constant draw weight having a handle portion, a flexible upper limb supported by the handle portion, and a flexible lower limb supported by the handle portion. The bow also having an upper rotational assembly rotatably mounted upon the upper limb for rotation about a first axle. The upper rotational assembly having at least one upper cable track. a lower rotational assembly rotatably mounted upon the lower limb for rotation about a second axle. The lower rotational assembly having at least a first lower cable track and a second lower cable track. The first lower cable track being a cable payout track, the second lower cable track constructed and arranged to payout a predetermined length of cable and simultaneously take up a second predetermined length of cable when the second cam assembly is rotated.

26 Claims, 7 Drawing Sheets

COMPOUND BOW SUITED FOR YOUTH, INTERMEDIATES AND TRAINING

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to archery bows. It is specifically directed to an improved bow for youths, intermediates and in general it is ideal for the training of individuals in the art of archery.

Prior to 1967 those people that participated in archery used bows that by today's standards would be considered as traditional. Traditional bows are those bows that exhibit the characteristic of requiring proportionately more force to displace the bowstring, or draw cable, from the brace position to the full draw position. Some of the bows that would be in this category would be the English Long Bow, the American Indian Flat Bow, the Turkish Recurve bow and the Modem Day Recurve Bows. The force to draw one of these traditional bows is approximated by the following relationship F=kx. Where "x" is the displacement of the bow string from the rest position, k is the force required per unit of displacement and "F" is the (Draw Weight) force required to hold the bow string at the displaced distance "x".

These traditional bows in low draw weights were often used to teach archery in public schools, 4H programs, Boy and Girl Scouts and in many Camp programs. Although low draw weight traditional bows could be used by a number of students of varying stature to learn archery and they could be used recreationally they also posed several problems. They could not be stored in a usable condition. The bows had to be unstrung for storage and then they had to be re-strung or brought to the brace condition prior to the next use. This alone required training and proper supervision to insure personal safety and prevent damage to the equipment. Because of the low poundage desirable for training proper archery form and skills, these bows had limited capability to store energy and therefore their shooting distance or range was also limited. Another draw back of these traditional bows became their cost to manufacture. These traditional bows require a great deal of hand crafting and today's cost to produce the lighter draw weight training bows can be nearly as great as the cost to produce a high end hunting, or target bow. The higher cost of producing traditional archery equipment has resulted in fewer organizations being able to afford archery-training programs. Then with the advent of the compound bow the general interest in shooting traditional archery equipment has also diminished to where the traditional market is less than 10% of the size of compound bow market.

With the wide acceptance of the compound bow it would seem natural that these would be the bows of choice for today's archery training programs if indeed a less expensive version could be made. Unfortunately the feature that makes the compound bow desirable to the end consumer also makes it less desirable as a training bow. The compound bow has a leverage lows the archer to store more energy in the bow limbs and requires less force to hold in the fully drawn condition than does the traditional bow. This means that compound bows tend to be draw length specific and each bow is designed to fit a certain draw length archer. In recent years the cam systems used on these bows have been designed to accept different draw length modules which can be interchanged to make a given bow adaptable to different individuals. Still changing these modules requires manipulation of the bow and would require considerable time and equipment to match a group of bows to a group of individuals. Then when a new group is to use these same bows a given number of these bows would have to be reworked again.

This same situation can exist when a bow is purchased for a new archer. With compound bows being draw length specific, each bow has to be matched to its new owner.

BRIEF SUMMARY OF THE INVENTION

In light of the shortcomings described above, the present invention as disclosed herein is directed to a new bow concept that has the benefit of the traditional bow in that it is not draw length specific, is easy for a beginner to use and for a given draw weight this innovative bow design stores more energy than a traditional bow. More specifically, the present invention provide for a compound bow which has a draw force characteristic that rapidly attains a given draw weight within a predetermined amount of bow string displacement, preferably within the first 8 inches or less of string displacement, and then maintains that draw weight or allows that draw weight to increase or decrease at a minimal rate to a final draw length, preferably of 32 inches or less.

The present invention provides bow for the learning archer that requires only the minimum amount of effort to reach their full draw length yet has sufficient energy storage to potentially out perform a traditional bow or compound bow of equivalent peak draw weight.

The inventive bow described herein does not require stringing prior to use or unstringing after use as most traditional bow do. As a result, the present invention is potentially safer to use in a training environment as accidents associated with improperly stringing a bow are substantially less likely to occur with a pre-strung compound bow such as the present invention. In addition, because the present bow is not draw length specific it can be used by virtually anyone and does not require special fitting or modification for different individuals. The draw force characteristic of this bow does not require the user to apply continually more force to draw the bow and then suddenly relax this requirement which can result in startling a novice archer and potentially result in their loosing the bow string prematurely.

The present invention provides or a bow that is easy to set up for a novice archer and does not require continuous maintenance or special tuning or timing to keep it in suitable condition for use.

In addition to the features described above, the present invention has an additional benefit of looking like a state of the art compound bow and can be manufactured using the same procedures used to make other compound bows. By looking like any other compound bow the bow will be more acceptable to beginning archers. Many of the people in this category will be youths and even though the subject bow has different and specific characteristics compared to a conventional compound bow it will appear to function like a standard compound bow under the circumstances that it is intended to be used.

The present invention includes aid is further directed to a number of different improvements and embodiments.

It is the object of at least one embodiment to provide an archery bow as described herein that can be easily drawn and shot by a youngster or a novice in the sport.

It is also an object of at least one embodiment to provide a single bow configuration that is suitable for use by a wide variety of potential participants of different ages, sex, stature, and physical ability.

A further object of at least one embodiment is to provide a bow that does not require as much preparation for use, is simple, user friendly and does not have to be assembled prior to use or disassembled for storage.

Still another object of at least on embodiment is to provide a bow that can be easily drawn and at the same time stores more potential energy than a conventional compound or traditional bow of equal draw length and draw weight.

Yet another object of at least one embodiment is to provide an archery bow that is so easy to use , versatile and cost effective that it is readily accepted by those organizations that have been instrumental in the instruction and promotion of archery such as school systems, 4H, Scouts, camps and other organizations.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
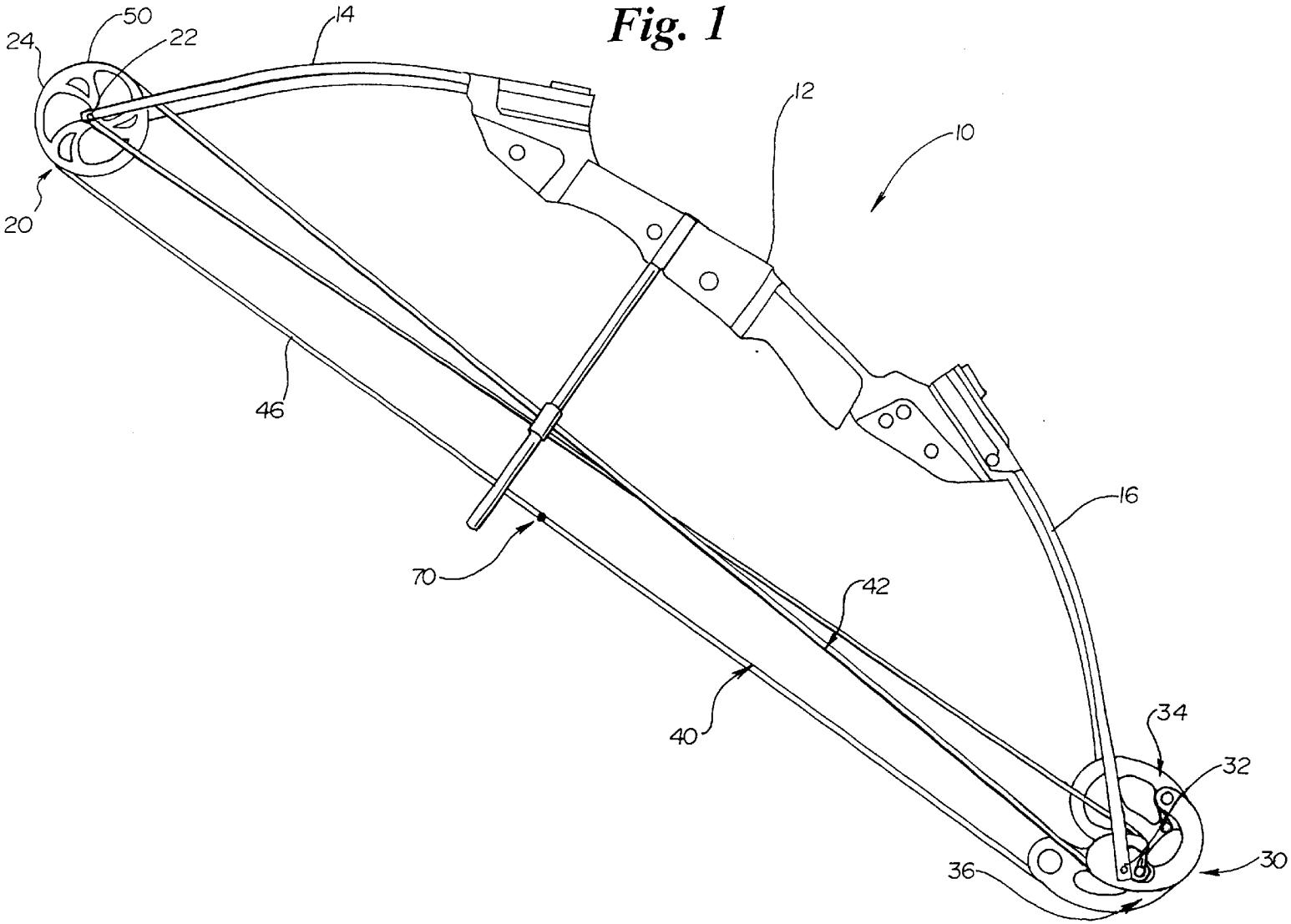
FIG. 1 is a side view of one embodiment of the present invention.
Figure 4:
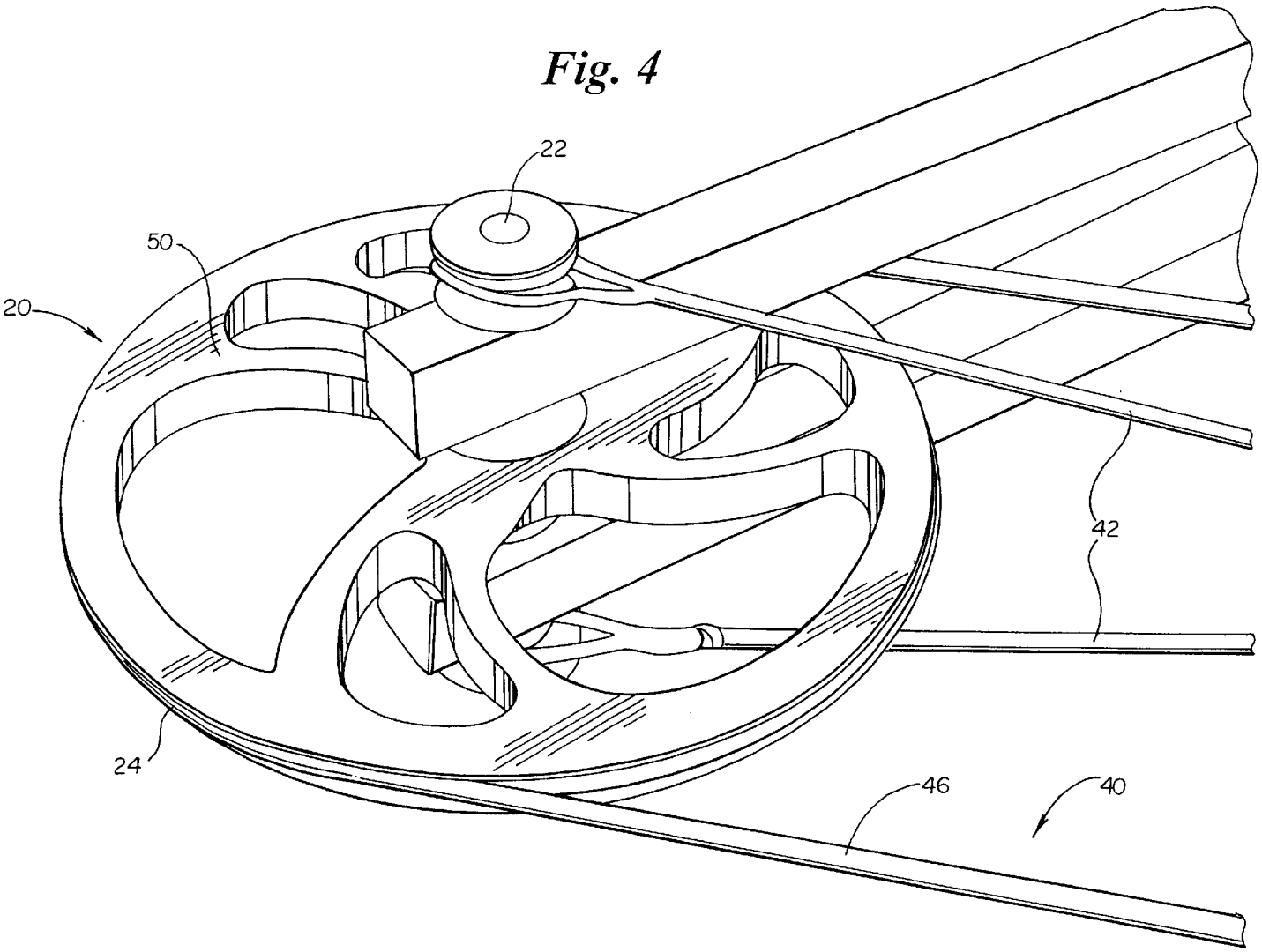
FIG. 4 is a close-up perspective view of one embodiment of an upper rotational assembly such as is depicted in FIG. 1.
Figure 5:
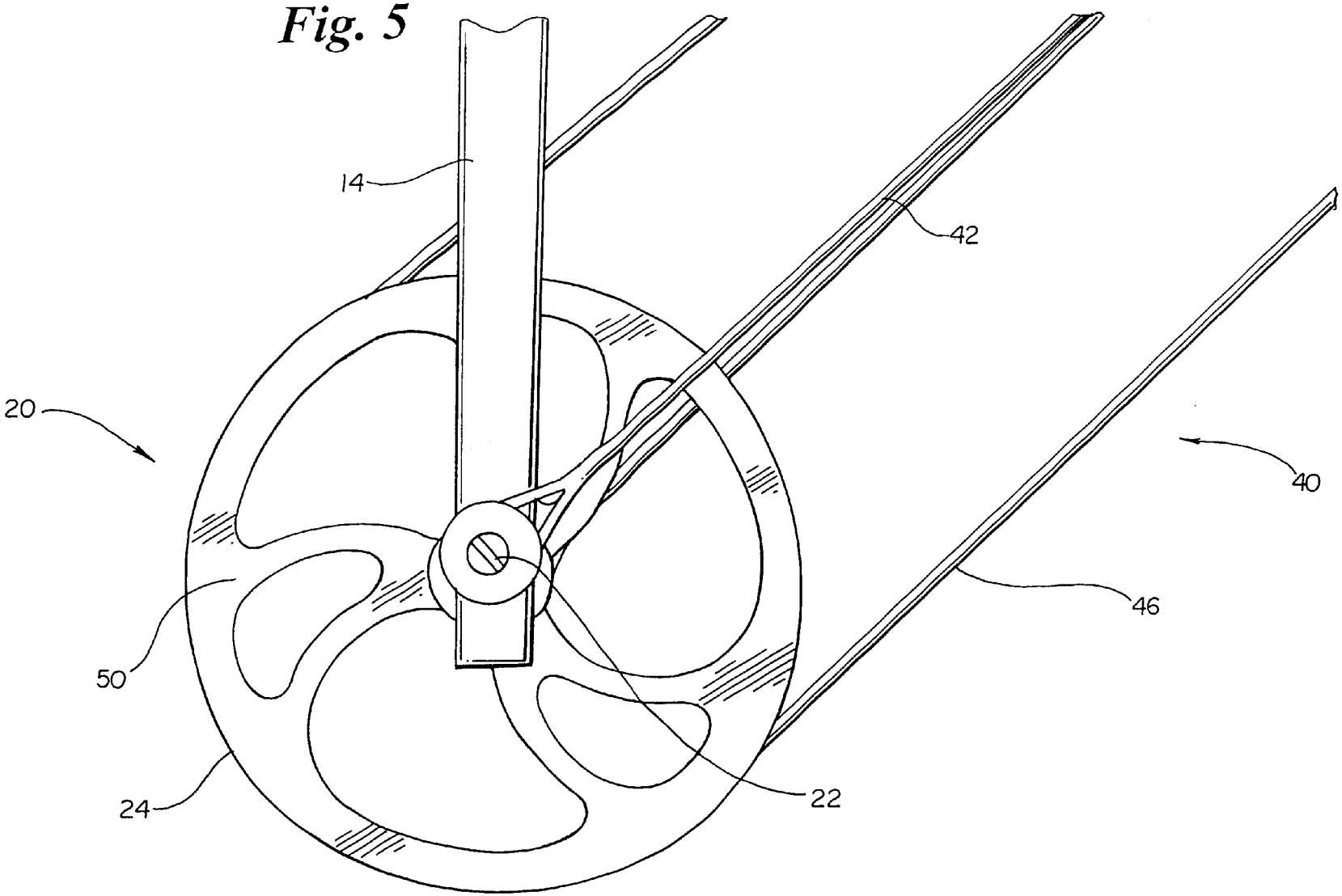
FIG. 5 is a close-up side view of the upper rotational assembly shown in FIG. 4.
Figure 6:
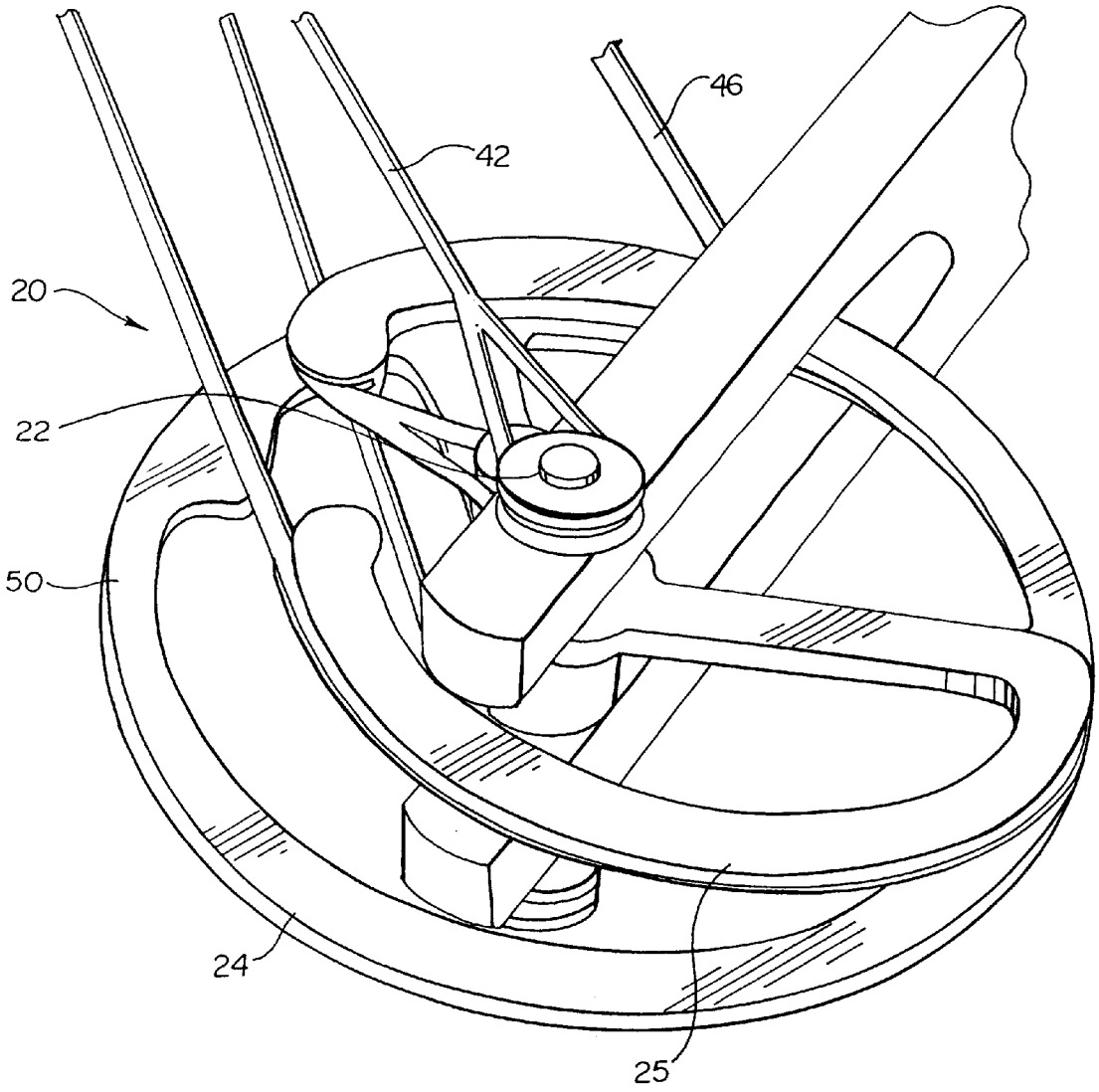
FIG. 6 is a perspective view of an embodiment of the lower rotational assembly.
Figure 7:
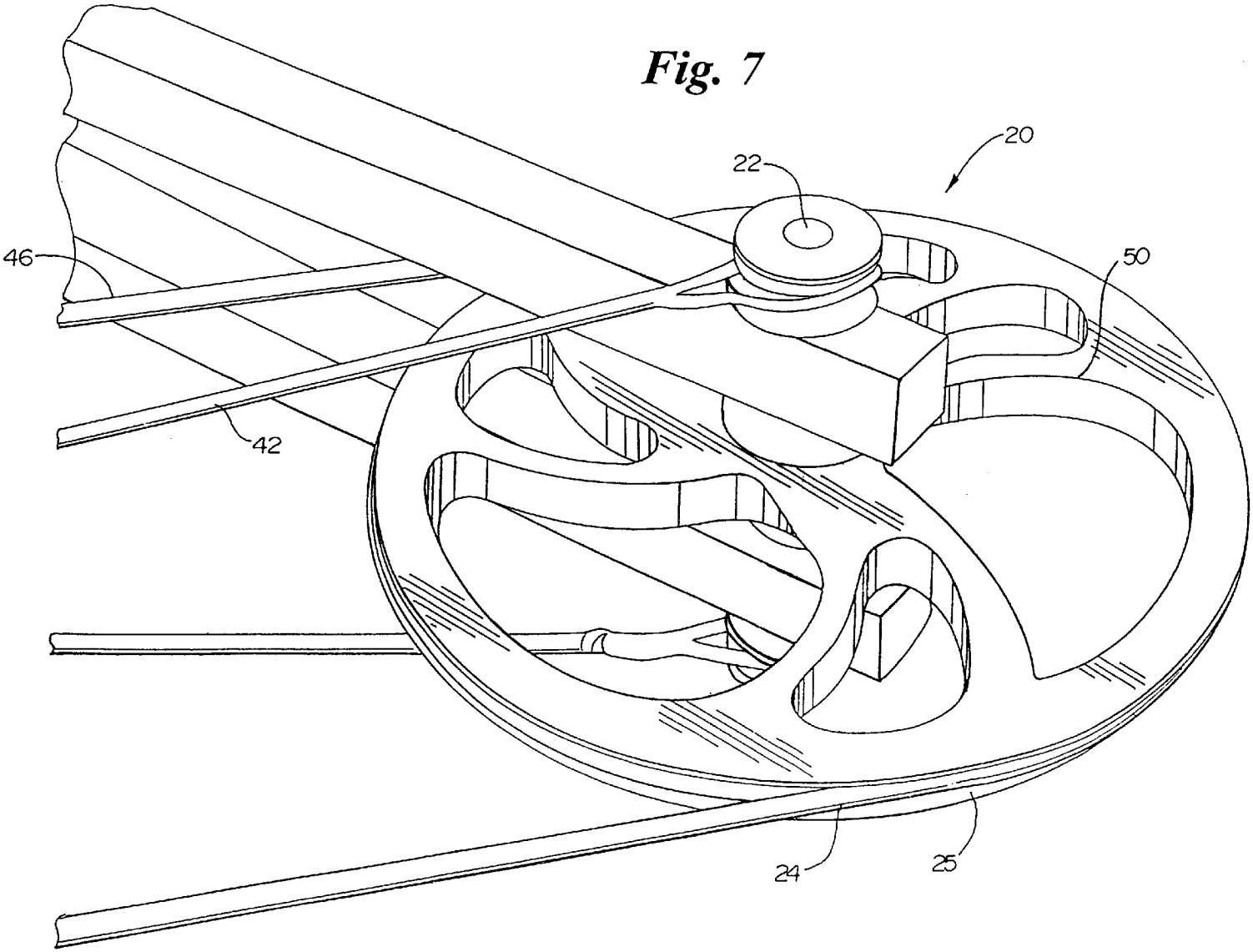
FIG. 7 is a perspective view of an embodiment of the lower rotational assembly.

As may be seen in FIG. 1, there is disclosed herein a compound bow, indicated generally at 10, which includes a handle 12 having a first and a second flexible limb 14 and 16 supported thereupon. The bow 10 includes a first or upper rotational assembly 20 which is pivotally mounted to the first limb 14 for rotation about an axle 22. The upper rotational assembly 20 may be a pulley 50, or a cam 60, such as may be seen in FIGS. 2, 3 and 8 and discussed in greater detail below. Where the upper rotational assembly is a pulley 50, such as may best be seen in FIGS. 4 and 5, the pulley 50 contains at least one groove or track 24 that defines a constant radius relative to the first axle 22. Alternatively, where the pulley is equipped with multiple tracks, the radius defined by a second pulley 50 track 25 may be eccentric relative to axle 22, such as may be seen in FIG. 6. A pulley 50 having two tracks 24 and 25 may also be utilized, wherein both tracks define a respective radius which is substantially constant, such as may be seen in FIG. 7

Figure 2:
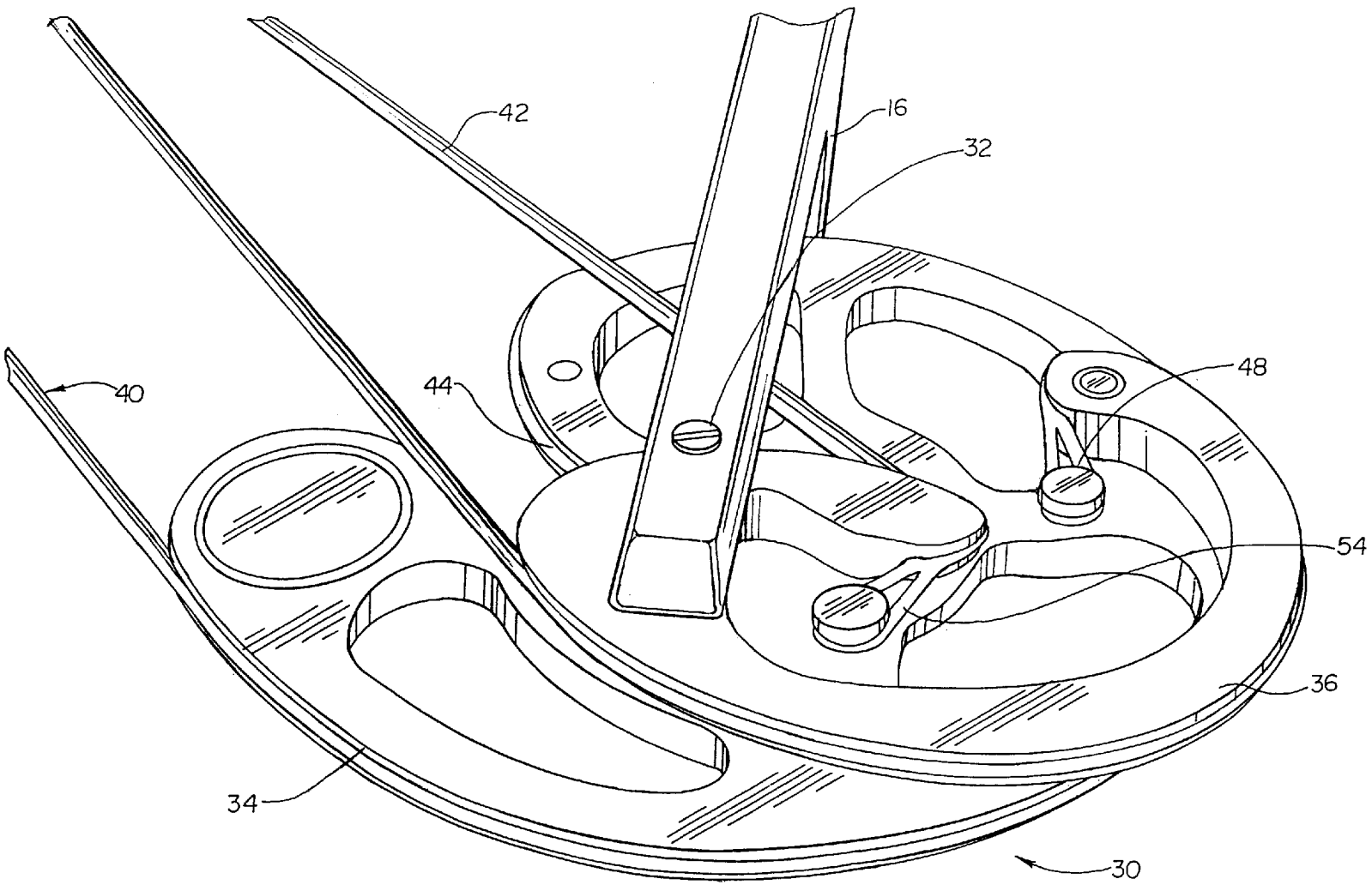
FIG. 2 is a close-up perspective view of one embodiment of a lower rotational assembly such as is depicted in FIG. 1.
Figure 3:
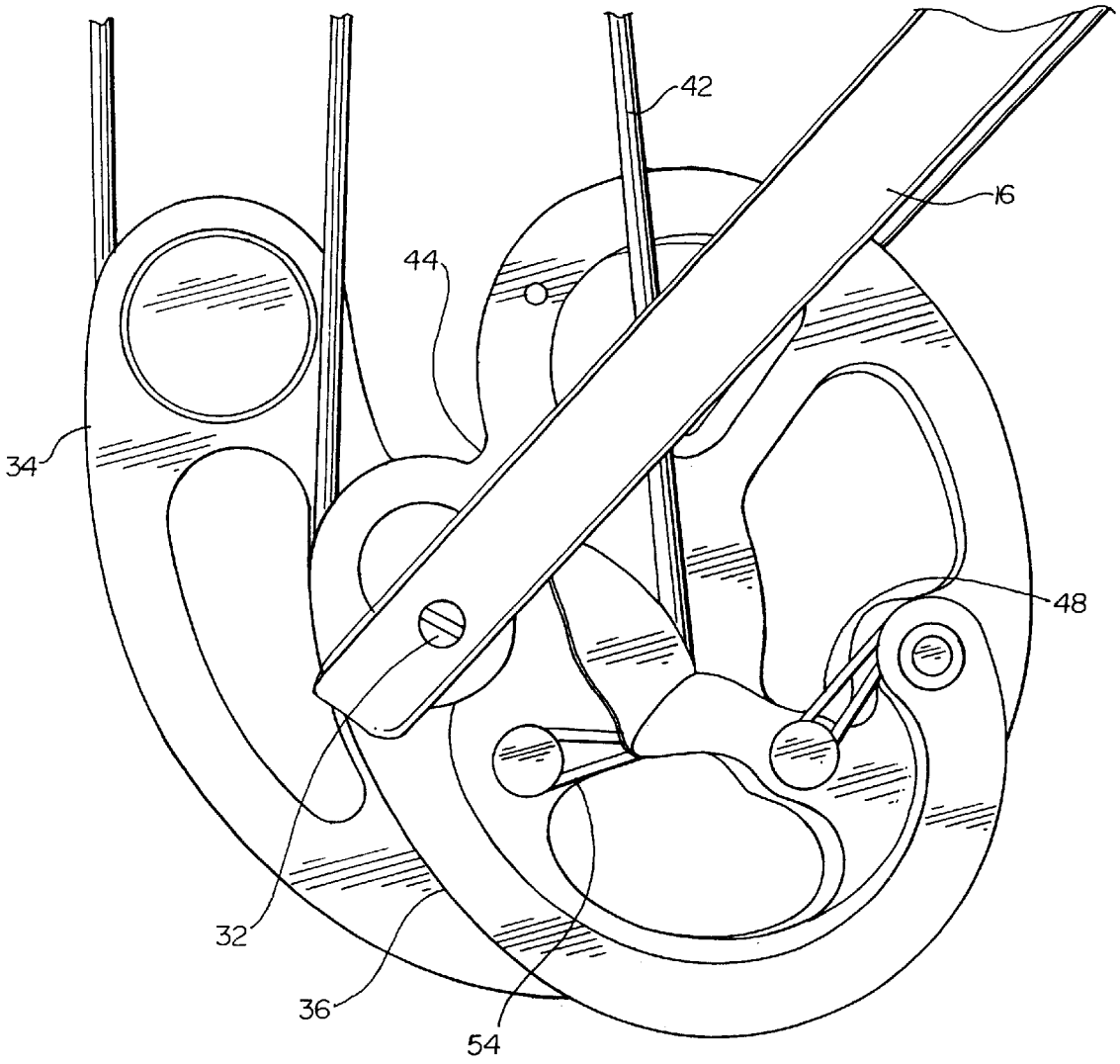
FIG. 3 is a close-up side view of the lower rotational assembly shown in FIG. 2.

The bow 10 also includes a second or lower rotational assembly which will typically be a cam 30, however pulleys such as those discussed above and shown in FIGS. 4–7. Cam 30, as may best be seen in FIGS. 2 and 3, is pivotally mounted upon the second limb 16 for rotation about a second axle 32. In addition, the cam 30 and the pulley 50 may be interchanged between the first and second limbs as desired.

The present invention is capable of providing a constant draw weight bow by providing the invention with the unique arrangement of rotational assemblies shown and described herein.

In the embodiment shown in FIG. 1, the second rotational assembly 30 has at least two tracks, a first lower cable track 34 and a second lower cable track 36, about its circumference 38. The larger of the two tracks, first lower track 34 provides primary pay-out of a first end 44 of bow string or cable 40 when the first cable 40 is drawn. The second lower track 36 simultaneously provides for pay-out of the secondary cable 42 as well as a power take-up of secondary cable 42 when the first cable 40 is drawn and the cam 30 rotates.

As shown in FIG. 2, the first cable 40 has a first end 44 engaged to the lower rotational assembly 30, a predetermined length of the first cable 40 extends from the first end 44 and is received into at least a position of the first lower cable track 34. Turning back to FIG. 1, the first cable 40 has an intermediate portion 46 which extends from the first lower cable track 34 and is received in the first upper cable track 24 of the upper rotational assembly 20. As may best be seen in FIGS. 2 and 3, the first cable 40 also has a second end 48. The second end 48 of the first cable 40 is likewise engaged to the lower rotational assembly. a second predetermined length of the first cable 40 extends from the second end 48 and is received in to at least a portion of the second lower cable track 36.

As is required of all bows, the present inventive bow is characterized as having a nock point 70. In the embodiment shown in FIG. 1, the nock point 70 is positioned on the first cable 40 and may further be characterized as being a predetermined point between first and second axles 22 and 32.

The present invention further includes a second cable 42. The second cable 42 has a first end 52 and a second end 54. The first end 52 is engaged to the first limb 14. In the embodiment shown the first end 52 is disposed about and connected directly to the first axle 22, however the first end 52 may be engaged or connected to substantially any portion of the upper limb. The second end 54 of the second cable 42 is engaged to the lower rotational assembly 30. As may best be seen in FIGS. 2 and 3, a predetermined length of the second cable 42 is received in at least a portion of the second lower cable track 36 of the lower rotational assembly.

When the first cable 40 is drawn or pulled, the first and second lower cable tracks 34 and 36 will rotate as the lower rotational assembly 30 rotates about the second axle 32. As the lower rotational assembly 30 rotates, the first cable 40 is unwound from the first lower cable track 34 at a rate which differs from the rate at which the first cable 40 is unwound from the second lower cable track 36. While the first cable 40 is being unwound from the first and second lower cable tracks 34 and 36, the second cable 42 is wound onto the second lower cable track 36.

The first and second lower cable racks 34 and 36 are constructed and arranged such that a draw force required to draw the bow rises to a predetermined value in a predetermined distance of nock point displacement or draw length. In the present embodiment, the bow will achieve a draw weight of approximately 25 lbs within the first 8 inches of nock point displacement. The predetermined value of the draw force is maintained at a substantially constant value subsequent to the nock point exceeding the predetermined distance to the full draw length. The present embodiment provides a substantially constant draw weight of approximately 25 lbs at an approximate distance of nock point displacement of 8 inches to the full draw length of the bow which is approximately 32 inches. It should be noted that the present invention may be constructed to have any draw weight as may be desired and known in the art, for example the draw weight may be between 20 lbs to 45 lb or more. Similarly, it may be desirable to construct the present bow to establish the constant draw weight at various distances from the initial draw. For instance the constant, draw weight may be established at between 5 to 9 inches of draw length.

As described above, the profiles id relationships of tracks 34 and 36 are such that the unique manner in which the first cable is unwound and the second cable is taken up allows the bow of the present invention to provide a smooth and substantially constant draw weight through out the majority of the draw length of the bow. Such a constant draw weight allows the bow to provide the improved performance characteristics regardless of most user's specific draw length.

In an alternative embodiment of the invention, the secondary cable pay-out function and the power cable take-up function may be provided for by an arrangement of independent tracks thus providing the second pulley assembly with three separate tracks. Such a cam having three tracks is disclosed in U.S. Pat. No. 5,809,982, the entire content of which is hereby incorporated by reference.

In a another alternative embodiment, the first and second rotational assemblies 20 and 30 arrangements each contain two tracks. The rotational assemblies may be characterized as pulleys or cams such as have been described herein. In such a bow, at least one of the tracks may be utilized to provide bowstring pay-out and at least another track in each pulley serves as a power cable take-up such as previously described. This arrangement would be similar in appearance to a standard twin cam compound bow arrangement such as is shown in U.S. Pat. No. 5,515,142, the entire content of which is hereby incorporated by reference. However, the profiles of the two rotational assemblies of the present embodiment are such that the tracks will allow the bow to rapidly attain the desired draw force and maintain that draw force through out the duration of the draw cycle as described herein.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An archery bow comprising:

a handle portion;

a first limb supported by the handle portion;

a second limb supported by the handle portion;

a first rotational assembly rotatably mounted upon the first limb for rotation about a first axle, the first rotational assembly having at least one table track;

a second rotational assembly rotatable mounted upon the second limb for rotation about a second axle, the second rotational assembly having at least a first cable track and a second cable track, the first cable being a cable payout track, the second cable track constructed and arranged to payout a predetermined length of cable and simultaneously take up a second predetermined length of cable when the second rotational assembly is rotated.

2. The archery bow of claim 1 further comprising:

a first cable, the first cable having a first end, the first and engaged to the second rotational assembly. a predetermined length of the first cable extending from the fist end received in at least a portion of the first cable track of the second rotational assembly, the first cable having an intermediate portion received in the first cable track of the first rotational assembly, the first cable having a second end, a second predetermined length of the first cable extending from the second end received at least a portion of the second cable track the second end of said first cable engaged to d second rotational assembly, the first cable further including a nock point, the nock point characterized as a predetermined point on the first cable between first and second axles;

a second cable having a fist end and second end the first end engaged to the first limb, the second end engaged to the second rotational assembly, a predetermined length of the second cable received in the second cable track of the second rotational assembly;

the first and second cable tacks of second rotational assembly constructed and arranged to rotate as the second rotational assembly rotates about the second ale when the bow is drawn, the first cable being unwound from the first cable track of the second rotational assembly at a rate which differs from a rate at which the fist cable is unwound from the second cable track of the second rotational assembly; the second cable being wound onto the second cable track of the second rotational assembly; and wherein the first and second cable tracks are constructed and arranged such that a draw weight required to draw the bow rises to a predetermined value in a predetermined distance of nock point displacement, and the predetermined value of the draw weight being maintained at a substantially constant value to a full draw length.

3. The bow of claim 2 wherein the predetermined value of draw weight is between 20 and 45 lbs.

4. The bow of claim 3 wherein the predetermined value of draw weight is approximately 25 lbs.

5. The bow of claim 2 wherein the predetermined distance is between 5 and 9 inches of initial nock point displacement.

6. The bow of claim 2 wherein the predetermined distance is approximately 8 inches.

7. The bow of claim 2 wherein the draw length is approximately 32 inches.

8. The bow of claim 2 wherein the draw length is 32 inches or less.

9. The archery bow of claim 1 wherein the first cable track of the first rotational assembly comprises a substantially constant radius relative to the first axle.

10. The archery bow of claim 9 wherein the first rotational assembly is a pulley.

11. A apt The archery bow of claim 9 wherein the first rotational assembly is a cam.

12. The archery bow of claim 1 wherein the first cable track of the second rotational assembly comprises a substantially constant radius relative to the second axle.

13. The archery bow of claim 12 wherein the second rotational assembly is a pulley.

14. The archery bow of claim 1, the first cable track of the second rotational assembly having a radius relative to the second axle, the radius being eccentric.

15. The archery bow of claim 14 the second cable track of the second rotational assembly having a radius relative to the second axle, the radius being eccentric.

16. The archery bow of claim 14 wherein the second rotational assembly is a cam. straight line as the upper and lower rotational assemblies rotate in opposite directions when the nock point is being displaced from an at rest position.

17. The archery bow of claim 1, wherein the nock point moves in a substantially straight line as the first and second rotational assemblies rotate in opposite directions when the nock point is being displaced from an at rest position.

18. The archery bow of claim 1, wherein the draw force varies no more than five percent of the maximum predetermined value over the distance of the nock point displacement between the first predetermined distance and the full draw length.

19. The archery bow of claim 1, wherein the first rotational assembly further comprises a second cable track.

20. The archery bow of claim 19 at least one of the first or second cable tracks of the fist rotational assembly having a radius relative to the first axle, wherein the radius is eccentric.

21. An compound archery bow comprising:

a handle portion;

a first limb supported by the handle portion;

a second lower limb supported by the handle portion;

an first rotational assembly, the first rotational assembly having at least one cable track; and a second rotational assembly, the second rotational assembly having at least two cable tracks, at least one of the cable tracks having a radius which is eccentric relative to an axle, at least one of the cable tracks constructed and arranged to take up cable and to simultaneously release cable when the second rotational assembly is rotated about the axle.

22. The compound archery bow of claim 21 wherein the bow has a substantially constant draw weight.

23. The compound archery bow of claim 22, the bow having no let-off.

24. The compound bow of claim 22, the bow having a constant nock point.

25. The compound bow of claim 21 wherein the second rotational assembly further comprises a third cable track, at least two cable tracks having radiuses which are eccentric relative to the axle, the two cable tracks having radiuses which are eccentric constructed and arranged to pay-out a predetermined portion of a first cable when the second rotational assembly is rotated about the axle, the third cable track constructed and arranged to take up a predetermined portion of a second cable as the second rotational assembly is rotated abut the axle.

26. A rotational cam for use in a compound archery bow comprising at least two cable tracks, at least one cable track constructed and arranged to simultaneously take-up and let-out a cable when the bow is drawn, at least one cable track constructed and arranged to exclusively let-out a cable when the bow is drawn, the rotational cam constructed and arranged to provide a compound bow with a substantially constant draw weight throughout a predetermined draw length.

* * * * *